US006482487B1

(12) United States Patent
Donahue

(10) Patent No.: US 6,482,487 B1
(45) Date of Patent: Nov. 19, 2002

(54) UNITARY STACK OF PAPER SHEETS FOR ITEM POSTING

(75) Inventor: P. Richard Donahue, Naples, FL (US)

(73) Assignee: P. R. Donahue Incorporated, Naples, FL (US)

( * ) Notice: Subject to any disclaimer, the term of this patent is extended or adjusted under 35 U.S.C. 154(b) by 715 days.

(21) Appl. No.: 08/888,547

(22) Filed: Jul. 7, 1997

(51) Int. Cl.[7] ..... B41L 1/24

(52) U.S. Cl. ..... 428/40.1; 24/67 R; 24/67 AR; 428/41.9; 428/42.1; 428/192; 428/220; 428/354; 462/62; 462/63; 462/72; 462/900; 462/901

(58) Field of Search ..... 428/40.1, 42.1, 428/41.9, 192, 220, 354; 24/67 AR, 67 R; 462/62, 63, 72, 900, 901

(56) References Cited

U.S. PATENT DOCUMENTS

| | | | | | |
|---|---|---|---|---|---|
| 2,030,135 | A | * | 2/1936 | Carpenter | 24/67 AR |
| 2,647,849 | A | | 8/1953 | Douglas et al. | |
| 3,464,842 | A | | 9/1969 | Jackstadt | |
| 3,675,844 | A | | 7/1972 | Sorrell | |
| 3,869,333 | A | * | 3/1975 | McMaster | 428/194 |
| 4,379,012 | A | | 4/1983 | Heymanns | |
| 4,582,737 | A | | 4/1986 | Torgerson et al. | |
| 4,735,837 | A | | 4/1988 | Miyasaka et al. | |
| 4,783,354 | A | | 11/1988 | Fagan | |
| 4,950,517 | A | | 8/1990 | Loggins | |
| 4,965,113 | A | | 10/1990 | Jones et al. | |
| 5,086,946 | A | | 2/1992 | Blackwell et al. | |
| 5,202,169 | A | * | 4/1993 | Spendlove | 428/194 |
| 5,622,761 | A | * | 4/1997 | Cole | 428/354 |
| 5,766,401 | A | * | 6/1998 | Campbell | 428/345 |

* cited by examiner

*Primary Examiner*—Nasser Ahmad
(74) *Attorney, Agent, or Firm*—Charles R. Wilson

(57) ABSTRACT

A unitary stack of paper sheets have individual paper sheets which are loosely bonded together in a manner whereby an individual paper sheet is easily removed and used as a base. Each paper sheet in the unitary stack has a pressure sensitive adhesive partially covering each face thereof in approximate aligned areas of the respective faces. A back face of the individual sheet is adhered to a substrate while a front face holds an item for posting. In use, an individual paper sheet is readily removed from the unitary stack, adhered on its back face to the substrate, and then an item posted on its front face.

11 Claims, 1 Drawing Sheet

UNITARY STACK OF PAPER SHEETS FOR ITEM POSTING

This invention relates to a unitary stack of paper sheets. More particularly, the invention relates to a unitary stack of paper sheets whereby each individual paper sheet is readily removed from the stack and used for item posting purposes.

BACKGROUND OF THE INVENTION

Many people are in the habit of posting notes, appointment cards, children's artwork, messages, grocery lists, emergency telephone numbers, invitations and other informational-type items in a central home or office location. Bulletin boards, of course, have long been used for posting items. Thumb tacks or some needle-like tipped implement is used to hold the items, normally printed paper items, to the bulletin board. The homeowner may use a refrigerator door or other appliance with a large metallic surface area for temporarily holding the items. Thin magnets, commonly referred to as refrigerator magnets, are widely used. Adhesive tape can also be used to tape edges or corners of the item to the substrate. A double sided tape is also occasionally used. Such means of posting an item for later referencing are convenient, though can be somewhat cumbersome to use.

A substantial number of homes do not have a bulletin board for posting purposes or a kitchen appliance with a metallic substrate. In fact, many modern appliances have non-metallic surface panels which do not interact with magnets. Posting of light-weight items is more difficult in such homes. Articles produced to fill the known need include mark and wipe boards and dry erase boards.

In accord with a need, there has been developed a unitary stack of paper sheets, each sheet of which can be used to form a base for adhering an item thereto. The unitary stack is economical to produce, its use is easily understood, and the individual paper sheets are reliable for their intended purpose.

SUMMARY OF THE INVENTION

A unitary stack of paper sheets has sheets loosely bonded together in a manner whereby the stack maintains its integrity during use yet permits each individual paper sheet in the stack to be readily removed. Each paper sheet has a front face and a back face. A pressure sensitive adhesive partially covers each face of each individual sheet in approximate aligned areas thereof. The pressure sensitive adhesive on the back face of the paper sheet allows the paper sheet to be adhered to a substrate. The pressure sensitive adhesive on the front face of the paper sheet is to receive and hold an item for posting.

DETAILED DESCRIPTION OF THE INVENTION

The unitary stack of individual paper sheets of the invention is particularly useful in a home setting and in an office setting. It is, for this reason, described in these settings in the following paragraphs. It can as well be used in an industrial setting or wherever there is a need to temporarily post a light-weight item for referencing purposes.

Figure 1:
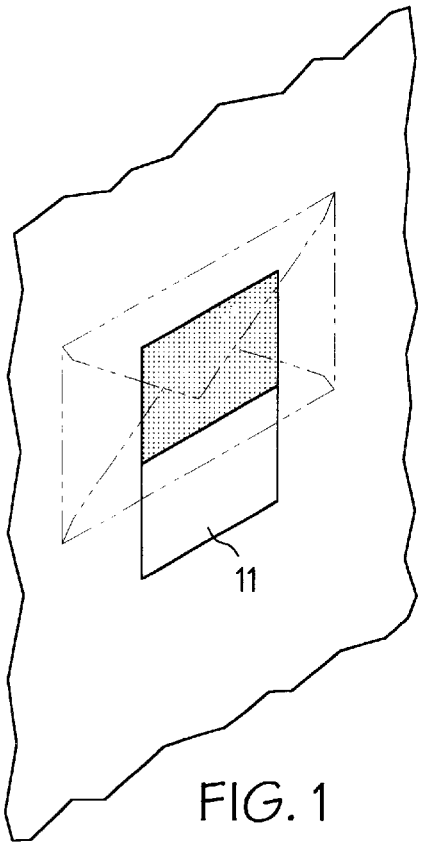
FIG. 1 is a perspective view of a unitary stack of paper sheets of the invention.
Figure 2:
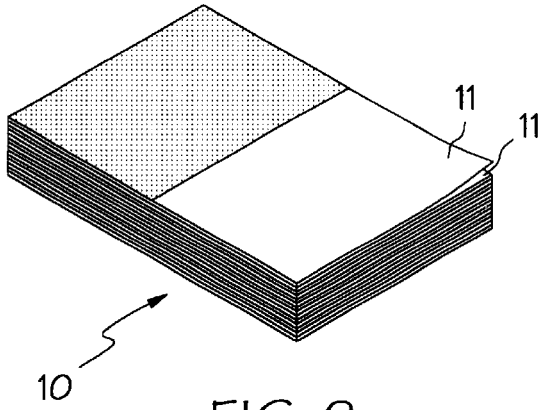
FIG. 2 is an environmental view of an individual paper sheet of the unitary stack of FIG. 1 adhered to a substantially vertical wall substrate with an envelope temporarily adhered thereto for posting purposes.

With reference to FIG. 1, there is shown a unitary stack 10 of the invention. The stack 10 is comprised of a plurality of individual uniformly shaped paper sheets 11 loosely bonded together sufficiently to maintain the integrity of the stack. The number of individual sheets in a stack can vary widely. For practical purposes, each unitary stack has at least about 10 individual sheets. Preferably, from about 10 sheets to about 100 sheets form a unitary stack. While not shown, preferably, a removable release sheet is included on top and bottom of the stack for packing reasons. The bottom release sheet normally remains in place until the unitary stack is deplenished of its individual paper sheets. As seen in FIG. 2, one of the individual paper sheets 11 is adhered to a substantially vertical substrate and has an envelope (shown in phantom) adhered to it.

Figure 3:
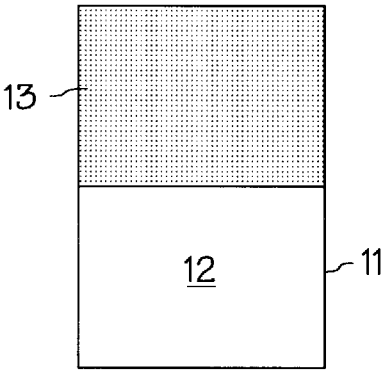
FIG. 3 is a top plan view of an individual paper sheet taken from the unitary stack of FIG. 1.
Figure 4:
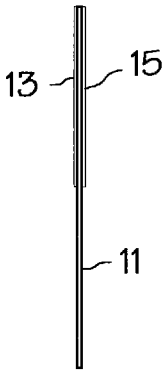
FIG. 4 is an end view of the individual paper sheet of FIG. 3.
Figure 5:
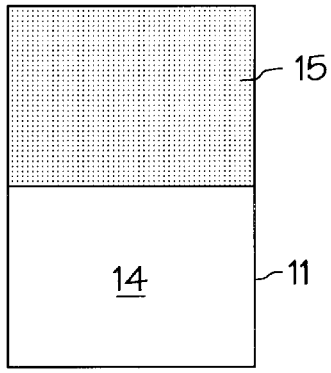
FIG. 5 is a bottom plan view of the individual paper sheet of FIG. 3.

As best seen in FIGS. 3–5, an individual paper sheet 11 taken from the unitary stack 10 has a front face 12 with an adhesive strip 13 partially covering it and a back face 14 with an adhesive strip 15 partially covering it. The size and shape of the individual sheets are not critical. For manufacturing and packaging purposes, the individual sheets and hence the unitary stack is preferably rectangular-shaped or square-shaped. Each paper sheet 11 ranges from about one-half inch to about six inches in width and about one inch to about five inches in length. A preferred paper sheet ranges from about two inches to about three inches in width and about two inches to about four inches in length. Larger sized paper sheets are feasible dependent on the intended use and are contemplated in this invention. Such larger sized paper sheets, though, tend to be for very specialized uses as found in an industrial setting.

The adhesive strips 13 and 15 on the individual paper sheets 11 partially cover the respective front face 12 and back face 14 thereof. It is important for the adhesive strip to not fully cover the faces in that the individual sheets are then more difficult to grasp and remove from the stack during use. The adhesive strips 13 and 15 are positioned on approximate aligned areas of the respective faces of the paper sheets 11.

Preferably, each adhesive strip on the paper sheets extends fully across the width of the faces. Preferably, each adhesive strip also extends down from a top edge to about 20% to about 80% the sheet's length and more preferably, from about 25% to about 60% the sheet's length. It has been found the preferred adhesive strip placement optimizes removal of individual sheets from the unitary stack and actual use of the individual sheets. Paper sheets which are fully covered on both sides by an adhesive are difficult to individually grasp and remove from the unitary stack. Conversely, too small of an adhesive strip will adversely affect the ability of the individual sheet to adhere to a substrate and/or to adequately hold an item to be posted.

Commercially available pressure sensitive adhesives are highly preferred for use in the invention. The adhesive must have a degree of adhesion sufficient to stick to a substrate and an item to be posted, yet be releasable. Adhesives having the proper degree of adhesion for the purpose contemplated in this invention are well known. Application of the adhesives on properly sized paper is done by conventional well known methods.

In use, the home owner or office worker who desires to post an item simply grasps an individual paper sheet from the unitary stack and pulls it therefrom. The sheet is then placed on a substrate in a convenient location. It can be used as is by writing on it, though in accord with the invention, an item to be posted is placed in contact with the adhesive strip on the front face of the paper sheet. It remains there for an indefinite time. In due course, the individual removes the item and reuses the paper sheet or simply removes and discards it.

Having described the invention in its preferred embodiment, it should be clear that modifications can be made without departing from the spirit of the invention. It is not intended that the words used to describe the invention nor the drawings illustrating the same be limiting on the invention. It is intended that the invention only be limited by the scope of the appended claims.

I claim:

1. A unitary stack of paper sheets with each paper sheet in the stack removable therefrom for adhering to a substrate and for providing a base for temporarily posting an item thereon, each paper sheet in the unitary stack having (i) a front face with a pressure sensitive adhesive partially covering an area of said front face and (ii) a back face with a pressure sensitive adhesive partially covering an area of said back face, wherein said adhesive partially covered areas on said front face and on said back face each extends substantially fully across the width of the paper sheet and each extends about the same length from a top edge of the paper sheet so that said adhesive partially covered areas are approximately aligned whereby an adhesive-free area is created for grasping and removing each said paper sheet from the unitary stack of paper sheets and further wherein the adhesive on said front face and on said back face has a degree of adhesion sufficient to stick to the substrate and the item to be posted, yet be releasable from adjacent paper sheets in the unitary stack.

2. The unitary stack of claim 1 wherein the adhesive is a pressure sensitive adhesive.

3. The unitary stack of claim 2 wherein each paper sheet in the stack ranges from about one-half inch to about six inches in width and about one inch to about five inches in length.

4. The unitary stack of claim 3 wherein each paper sheet in the stack ranges from about two inches to about three inches in width and about two inches to about four inches in length.

5. The unitary stack of claim 3 wherein each paper sheet in the stack is rectangular-shaped.

6. The unitary stack of claim 3 wherein each of the adhesive strips extends from a top edge of the paper sheet to about 20% to about 80% the length of the paper sheet.

7. The unitary stack of claim 6 wherein each of the adhesive strips extends from a top edge of the paper sheet to about 25% to about 60% the length of the paper sheet.

8. The unitary stack of claim 2 wherein the stack contains at least about 10 paper sheets.

9. The unitary stack of claim 8 wherein the stack contains from about 10 paper sheets to about 100 paper sheets.

10. The unitary stack of claim 1 wherein the stack contains at least about 10 paper sheets.

11. A unitary stack of at least about 10 paper sheets, said stack comprising a plurality of equally-sized paper sheets each having a front face, a rear face facing in a direction opposite from the front face, a top edge, a bottom edge spaced from the top edge, and a pair of laterally spaced side edges extending between the top and bottom edges, each sheet including a pressure sensitive adhesive covering a portion of the front face and a portion of the back face, the pressure sensitive adhesive extending continuously from the top edge of the sheet on each of the front and rear faces to a position between the top and bottom edges of the sheet to expose front and rear areas of the sheet devoid of adhesive to facilitate grasping of a sheet for removal, the adhesive extending continuously between the side edges of the sheet to define on each face of the sheet an area that is completely covered with adhesive, wherein the stack of sheets is defined by a plurality of sheets in which adjacent sheets are disposed in front-face to rear-face relationship with the respective top, bottom, and side edges of adjacent sheets in registry with each other.

* * * * *